United States Patent [19]

Sakaki et al.

[11] 4,088,181

[45] May 9, 1978

[54] DISC TYPE MATRIX OF ROTARY REGENERATIVE HEAT EXCHANGER

[75] Inventors: Yoshihiro Sakaki, Suwa; Takeshi Mitomo, Kitamoto; Akitsuna Nakagaki, Tokyo, all of Japan

[73] Assignees: Nissan Motor Company, Ltd., Yokohama; Kabushiki Kaisha Tsuchiya Seisakusho, Tokyo, both of Japan

[21] Appl. No.: 665,397

[22] Filed: Mar. 10, 1976

[30] Foreign Application Priority Data

Mar. 11, 1975 Japan ..... 50-28615

[51] Int. Cl.[2] ..... F28D 19/00

[52] U.S. Cl. ..... 165/8; 165/10

[58] Field of Search ..... 165/8, 9, 10

[56] References Cited

U.S. PATENT DOCUMENTS

| | | | |
|---|---|---|---|
| 3,392,776 | 7/1968 | Topouzian | 165/8 |
| 3,401,741 | 9/1968 | Paluszny et al. | 165/10 X |
| 3,456,518 | 7/1969 | Topouzian | 165/8 X |
| 3,762,463 | 10/1973 | Sababi et al. | 165/8 |

*Primary Examiner*—Albert W. Davis, Jr.

[57] ABSTRACT

A disc type matrix is constructed by spirally winding as a unit a flat sheet metal strip and a longitudinally corrugated sheet metal strip. The outermost layer of the matrix is formed with the flat sheet metal strip and has, on the circumferential surface thereof, a plurality of recesses for receiving coupling members which are arranged to couple the matrix and a driving ring gear member.

8 Claims, 6 Drawing Figures

DISC TYPE MATRIX OF ROTARY REGENERATIVE HEAT EXCHANGER

This invention, in general, relates to a heat exchanger and more particularly to the construction of a regenerative heat exchanger of the rotary disc type commonly used in gas turbine engines.

One of the object of the present invention is to provide an improved rotary regenerative heat exchanger which overcomes the drawbacks encountered by the prior art.

A further object of the present invention is to provide an improved rotary regenerative heat exchanger which is not subjected to damage by unequal thermal expansion occuring due to a temperature gradient during normal operation.

A still further object of the present invention is to provide an improved rotary regenerative heat exchanger having a metallic matrix which does not tend to be inoperatively deformed by unequal thermal expansion which occurs due to a temperature gradient during normal operation.

Other objects, features and advantages of the present invention will become more apparent upon reference to the succeeding detailed description thereof, and to the drawings illustrating the preferred embodiments thereof, in which.

Regenerative heat exchangers, either of the rotary disc or rotary drum type, are used in gas turbine units to extract heat from the exhaust gases, and to transfer this heat to the output air from the compressor associated with the gas turbine unit. The matrix of the heat exchanger is designed to present a large surface area to the flow of the gases, and is mounted in a casing in such a way that it can be rotated so that its surface area is presented first to the hot exhaust gases, under which condition it heats up, and subsequently to the air from the compressor, so that it is cooled down, thus transferring heat. Usually, a duct carrying the intake-air for the turbine, from the compressor outlet, is arranged to abut a portion of the surface of the matrix through a sealing device, and a second coaxial duct on the opposite face of the matrix conveys the intake-air (which has passed through the matrix) to the combustion chamber of the gas turbine; a similar pair of ducts conveying the exhaust gases from the turbine through the matrix and to the atmosphere. In this way an amount of fuel equivalent to the quantity of heat transferred is saved.

Figure 1:
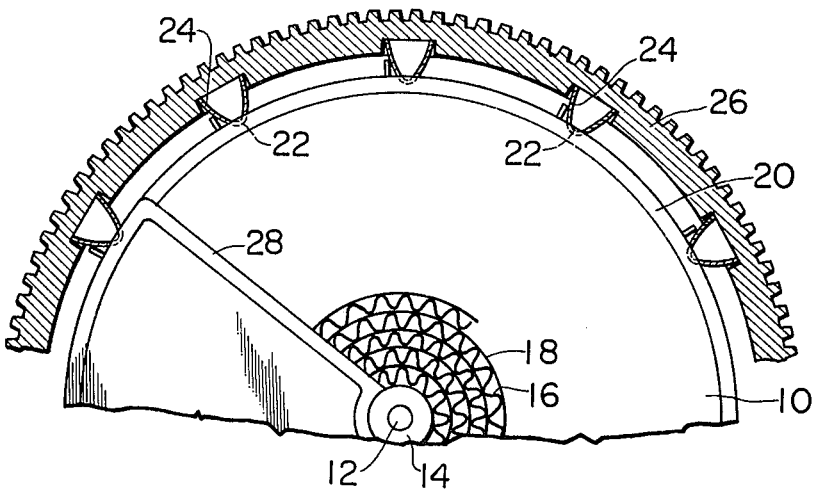
FIG. 1 PRIOR ART
FIG. 1 is a cross-sectional view of a prior art rotary regenerative heat exchanger portion of a gas turbine.

FIG. 1 shows a portion of a prior art rotary regenerative heat exchanger for use in a gas turbine engine, in which the matrix 10 is arranged to rotate about an axis

12 on a tubular hub 14. The matrix 10 is constructed by spirally winding as a unit two continuous thin sheet metal strips 16 and 18, the strip 16 being circumferentially corrugated and the strip 18 flat. As shown, the corrugated strip 16 is super-imposed upon the flat strip 18. The strips initially are tacked to the tubular hub 14 and when wound to the desired diameter, the flat sheet 12 is welded to itself. Secured to the circumferential surface of the matrix 10 is a rigid metal rim 20 which is equipped with a plurality of recesses 22 formed on the outer peripheral surface of the rim 20. A plurality of heat-resistant resilient coupling members 24 are disposed in the corresponding recesses 22. The coupling members 24 are securely held in the recesses of a driving ring gear member 26 which is concentrically and spacedly disposed around the circumferential surface of the matrix 10. The ring gear member 26 is arranged to be rotated by a suitable means to simultaneously rotate the matrix 10 through the coupling members 24. Mounted slidably and sealingly on the side surface of the matrix 10 is the sealing device 28 which functions to prevent the mixing of the hot exhaust gases and the cool air from a compressor (not shown). It is be noted that the resilient coupling member 24 functions not only to transmit the torque from the ring gear member 26 to the matrix 10 but also to absorb the expansion and contraction of the total assembly of the rim 20 and the matrix 10 due to extreme temperature variation.

However, the prior art configuration mentioned above has encountered a difficulty in which the deformation or break-down of the matrix 10 tends to occur due to the following: the matrix 10 is subjected to a relatively high temperature during normal operation since the hot exhaust gases pass therethrough, whereas the rim 20 secured on the circumferential surface of the matrix 10 is not subjected to such a high temperature since the hot exhaust gases do not contact same. Thus a temperature gradient occurs and accordingly, although the matrix 10 expands to a considerable extent, the ring gear member 26 does not expand to a corresponding extent. Therefore, the thermal expansion of the outer diameter of the matrix 10 is restricted by the rim 20 which is usually made of a material having a relatively high rigidity. Additionally, a further problem has arisen in which a portion of the thin sheet metal strips 16 and 18 of the matrix 10 which contacts the rim 20 are deformed or broken-down, making it impossible to operate the heat exchanger. As a result of the relatively high force applied to the portion of the sheet metal strips 16 and 18 contacting the rim 20 when the matrix 20 is forced to turn; the strips 16 and 18 being generally as thin as about 0.1 mm thereby endowing flexibility.

The present invention intends to overcome the above disadvantages by eliminating the rim secured on the circumferential surface of a disc type matrix, and directly forming, on the circumferential surface of the matrix, a plurality of recesses for receiving a plurality of resilient coupling members fastened to the driving ring gear member.

Figure 2:
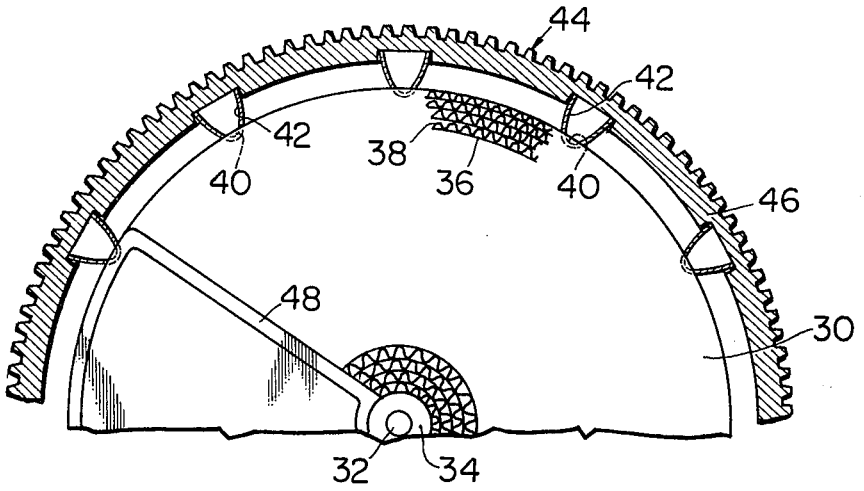
FIG. 2 is a cross-sectional view of a rotary regenerative heat exchanger portion in accordance with the present invention.

Referring now to FIG. 2, there is shown a preferred embodiment of a rotary regenerative heat exchanger portion of a gas turbine engine (not shown) in accordance with the principle of the present invention, in which a disc type matrix 30 is arranged to be rotatable about an axis 32 through a tubular hub 34 fixed to the matrix 30. The matrix 30 includes a spirally wound stack of a flat thin sheet metal strip 36 and a longitudinally corrugated thin sheet metal strip 38, and is constructed by spirally winding and bonding to each other as a unit two continuous thin sheet metal strip 36 and 38. As seen, the flat strip 36 is superimposed upon the corrugated strip 38. The strips initially are tacked to the tubular hub 14 and when wound to the desired diameter, the flat sheet strip 36 is welded to itself. In this instance, metal strips 36 and 38 are made of 18-8 stainless steel. It is to be noted that the outermost layer of the stack of matrix 30 is formed with the flat sheet metal strip 36 and having a plurality of recesses 40 on the circumferential surface thereof. A plurality of heat-resistant coupling members 42 of the plate spring type having a U-shaped cross-section are disposed in the corresponding recesses 40. The coupling members 42 forming part of driving means 44 are fixedly held in the recesses (no numeral) formed on the inner peripheral surface of a driving ring gear member 46 which is concentrically and spacedly disposed around the circumferential surface of the matrix 30. The ring gear member 46 is arranged to be rotated by a suitable means to simultaneously rotate the matrix 30 through the coupling members 24. Mounted slidably and sealingly on the side surface of the matrix 30 is a sealing device 48 which functions to prevent the mixing of the hot exhaust gases and the cool air from a compressor (not shown).

Figure 3:
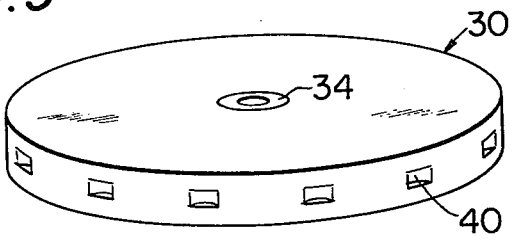
FIG. 3 is a perspective illustration of a matrix of the disc type included in the heat exchanger shown in FIG. 2.
Figure 6:
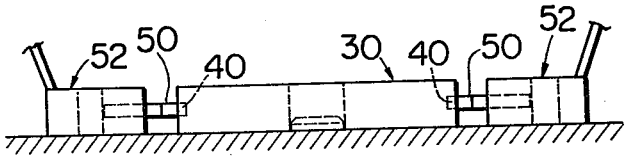
FIG. 6 is a schematic illustration showing a manner for forming recesses on the circumferential surface of the matrix.

FIG. 3 illustrates the arrangement of the recesses 40 formed on the circumferential surface of the matrix 30. The recesses 40 are located on the circumferential surface of the matrix 30 in such a manner that two of the recesses are opposed to each other with respect to the center axis (not shown) of the matrix 30 and the intervals between the adjacent recesses are equidistant in order to unify the torque applied to the respective recesses 40 said torque being transmitted from the driving ring gear member 46. In this connection, preferably twelve recesses 40 are formed equidistantly on the circumferential surface of the matrix 30. In this instance, the formation of the recesses 40 is achieved by press work as seen in FIG. 6 in which a plurality of molds 50 having shaped projections corresponding to the shape of the recesses 40 are pressed under load into the circumferential surface of the matrix 30. The molds 50 are arranged to be moved by means of hydraulically or pneumatically operated press machines 52.

Figure 4:
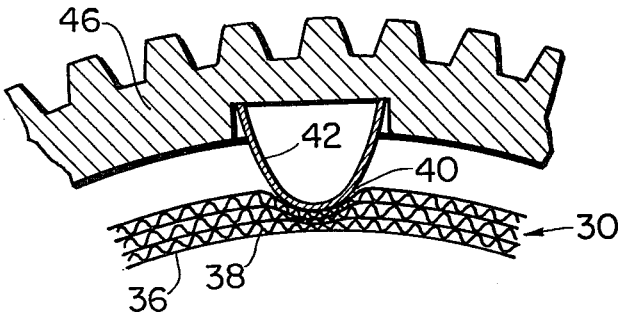
FIG. 4 is an enlarged view of a part of the heat exchanger shown in FIG. 2.

FIG. 4 shows in detail the stack structure beneath the recess 40 formed by the above-described press work. It will be understood that since portions of the stack structure beneath the recesses 40 are higher in density (as shown) than the other portions, they therefore are higher in mechanical strength than the other portions. Additionally, since each of the recesses 40 are formed by being pressed with a load of at least 1 ton, preferably about 1.5 tons which is considerably larger than the force applied to the each recess 40 during turning of the matrix 30, the deformation or break-down of the portions of the matrix adjacent the recesses 40 does not occur as a result of the torque transmitted from the driving ring gear member 46.

Figure 5:
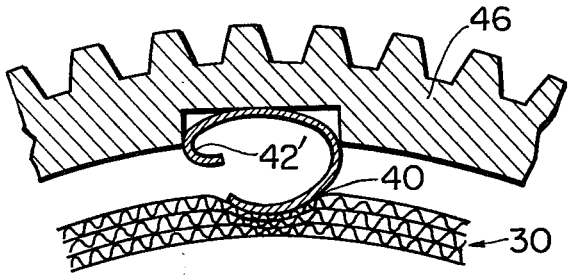
FIG. 5 is an enlarged view of a part of a modified embodiment of the rotary regenerative heat exchanger according to the present invention.

FIG. 5 shows a modified embodiment of the present invention which is similar to the embodiment shown in FIGS. 2, 3 and 4 with the exception that each of the resilient coupling members 42' is generally in the form of cylinder having a longitudinal opening therethrough and made of a heat-resistant alloy steel which may be one sold under the resistered trade mark of INCONEL X.

As is apparent from the foregoing, since the rotary regenerative heat exchanger according to the present invention does not employ a rigid rim secured on the circumferential surface of the matrix, the expansion and contraction in the diametrical direction of the matrix 30 is not restricted and therefore the deformation or breakdown of the matrix 30 is effectively prevented.

What is claimed is:

1. A rotary regenerative heat exchanger for use in a gas turbine engine, comprising:

a disc type matrix arranged to be rotatable about the center axis thereof, said disc type matrix including a spirally wound stack of a flat sheet metal strip and a longitudinally corrugated sheet metal strip, the outermost layer of the matrix being formed with a part of the flat sheet metal strip, a plurality of recesses formed on the circumferential surface of the outermost layer thereof, and a plurality of portions of the wound stack, respectively adjacent to the recesses each of which portions is of a layer formed by a plurality of flat sheet metals constituting the flat sheet metal strip and a plurality of longitudinally corrugated sheet metals constituting the corrugated sheet metal strip in which each flat sheet metal is superimposed upon each corrugated sheet metal, said layer being higher in density than the other portions of the wound stack in which the intervals among the flat sheet metals are smaller than those in the other portions of the wound stack; and driving means for forcing to rotatable said disc type matrix by applying the torque to the matrix through the recesses thereof.

2. A rotary regenerative heat exchanger as claimed in claim 1, in which said driving means includes:

a driving ring gear member concentrically and spacedly disposed around the circumferential surface of the matrix; and a plurality of resilient coupling members which are fixedly secured to the inner peripheral surface of the ring gear member and respectively disposed in the recesses of matrix.

3. A rotary regenerative heat exchanger as claimed in claim 2, in which said driving ring gear member has a plurality of recesses on the inner peripheral surface for holding therein said plurality of coupling members.

4. A rotary regenerative heat exchanger as claimed in claim 2, in which each of said coupling members is a plate spring of a U-shaped cross-section.

5. A rotary regenerative heat exchanger as claimed in claim 2, in which each of said coupling members is a plate spring in the form of cylinder having a longitudinal opening therethrough, said spring being made of a heat-resistant alloy steel.

6. A rotary regenerative heat exchanger as claimed in claim 5, in which said heat-resistant alloy steel is INCONEL X.

7. A rotary regenerative heat exchanger as claimed in claim 1, in which said recesses are located in such a manner that two of the recesses are opposed to each other with respect to the center axis of the matrix.

8. A rotary regenerative heat exchanger as claimed in claim 7, in which the intervals between the adjacent recesses are equidistant.

* * * * *